United States Patent [19]

Torii et al.

[11] Patent Number: 4,967,510

[45] Date of Patent: Nov. 6, 1990

[54] CLOSURE DEVICE

[75] Inventors: Katsuhiko Torii, Shizuoka; Tsutomu Saito, Toyohashi; Youji Higuchi, Okazaki; Kengo Yamamura, Shizuoka, all of Japan

[73] Assignees: ASMO Co., Ltd., Shizuoko; Nippondenso Co., Ltd., Aichi, both of Japan

[21] Appl. No.: 387,277

[22] Filed: Jul. 31, 1989

[51] Int. Cl.[5] ..... E05F 15/16

[52] U.S. Cl. ..... 49/358; 49/349; 49/362

[58] Field of Search ..... 49/358, 349, 362

[56] References Cited

U.S. PATENT DOCUMENTS 3,263,367 8/1966 Tanaka ..... 49/362 X
4,167,834 9/1979 Pickles ..... 49/358
4,170,847 10/1979 Pickles ..... 49/358 X
4,389,818 6/1983 Sakamoto ..... 49/349

FOREIGN PATENT DOCUMENTS 60-68284 5/1985 Japan .
61-286485 12/1986 Japan .

*Primary Examiner*—Philip C. Kannan
*Attorney, Agent, or Firm*—Venable, Baetjer and Howard

[57] ABSTRACT

A closure device for opening and closing an opening by moving a closure member substantially vertically has a motor for driving the closure member. The motor is secured to a lower portion of the closure member and within substantially the same plane as the plane of movement of the closure member. Accordingly, it is possible to prevent an eccentric load from being applied to the closure member.

20 Claims, 6 Drawing Sheets

CLOSURE DEVICE

BACKGROUND OF THE INVENTION

1. Field of the Invention

The present invention relates to a closure device, and more particularly to a closure device suitably used for opening and closing a window, sun-roof panel, etc., of an automobile or the like.

2. Statement of the Related Art

A power window regulator, which has become popular in recent years, for use on, for example, passenger cars, will be described as an example of the conventional closure device of this type.

As a mechanism for raising and lowering window glass, the X-arm system, the tape system, the wire system, etc. are adopted for the conventional power windows, and in the respective cases a drive motor is fixed to a door body.

In the X-arm system, the X-arm is moved vertically by the drive motor. In the case of the tape system and the wire system, on the other hand, the window glass is opened or closed by taking up or paying out the tape or wire by the drive motor.

With the above-described mechanisms, the following drawbacks have been encountered:

(1) Since the mechanism takes up practically the entire inner space of the door, it is difficult to mount door lock parts and others in the limited space of the door interior, and it is difficult to make the door thin. In particular, the number of parts accommodated inside the door has increased in recent years, so that if this mechanism is adopted, restrictions are inevitably imposed on special functions of door portions.

(2) In the X-arm system, numerous regulator parts are used, and since most of these parts are made of metal in view of the strength, it has been difficult to adopt lightweight drive portions. In addition, since the driving efficiency is poor, it has been necessary to use a motor having a large torque.

(3) In the case of the tape system and the wire system, it is possible to make the parts lightweight as compared with the aforementioned X-arm system, but since the tape or wire is bent, durability has been unsatisfactory. In addition, since the driving efficiency is poor as in the case of the X-arm system, a large-torque motor has been similarly required.

Accordingly, to solve such problems, improvements have been proposed to permit a substantial reduction in the number of parts used by causing the drive motor to move together with the window glass, thereby making it possible to make effective use of the inner space of the door.

These proposals are disclosed in, for instance, Japanese Utility Model Laid-Open No. 68284/1985 and Japanese Patent Laid-Open No. 286485/1986, but the arrangement of Japanese Utility Model Laid-Open No. 68284/1985 will be described herein by way of example.

As shown in FIG. 8, the power window disclosed in this publication comprises a glass holder 12 fixed to the lower end of a window glass 10, a reversible motor 14 fixed to the glass holder 12, a pinion gear 18 rotatively driven by the motor 14 via a worm gear 16, and a rack 20 fixed vertically to an inner panel of the door and meshing with the pinion gear 18.

In accordance with this power window, since a system is adopted in which the window is driven by the rack 20 and the pinion gear 18, the number of parts used is small. In addition, since only the rack 20 is fixed vertically to the inner panel of the door, it is possible to make effective use of the inner space of the door.

However, with the above-described power window employing the rack-and pinion system, although it is possible to overcome the drawbacks experienced with the conventionally available X-arm system and the like, new problems have emerged, as will be described below.

In other words, in the system shown in FIG. 8, as shown in FIG. 9 in which the mechanism shown in FIG. 8 is viewed in the direction of arrow A in the drawing, distance L2 between the central line of a window glass 10, i.e., an operating point, and a central line of the rack and pinion assembly which generates a driving force for vertically driving the window glass 10 becomes large as it is restricted by the thickness of the glass holder 12, motor 14, and pinion gear 18 that are sequentially superposed on each other. Accordingly, in addition to the vertical driving force, angular moment proportional to the aforementioned distance L2 acts on the window glass 10, i.e., a closure member, and the driving efficiency has therefore been appreciably aggravated.

In consequence, at the time of opening or closing the window glass 10, a frictional force attributable to the aforementioned angular moment constantly acts on the window glass 10, so that there has been a problem in that, in order to obtain a positive opening and closing operation, a torque which is more than is necessary is required of the motor 14.

Furthermore, since the motor 14 is disposed at a position offset from the path of travel of the closure member, the motor 14 which has a substantial weight exerts an eccentric load on the closure member, so that there has been another problem in that the aforementioned frictional force is disadvantageously increased.

Moreover, as described above, since the arrangement is such that the glass holder 12 motor 14, and pinion gear 18 are superposed sequentially on each other, there has been a further problem in that these members occupy the inner space of the door in the direction of the thickness of the door.

SUMMARY OF THE INVENTION

Accordingly, an object of the present invention is to provide a closure device which is based on a rack-and-pinion system and is yet capable of reducing the space occupied by the closure mechanism to a greater degree than a conventional closure device based on the rack-and-pinion system and of opening and closing a closure member with a smaller motor torque while reducing the number of parts used and securing the effective use of the surrounding space, thereby overcoming the above-described drawbacks of the conventional art.

To this end, in accordance with the present invention, there is provided a closure device for opening and closing an opening by moving a closure member substantially vertically, comprising: a rack secured to the opening member along the direction of movement thereof; a pinion gear meshing with the rack; and a motor having an output shaft connected to the pinion gear, the motor being supported by a lower portion of the closure member in such a manner that the output shaft is located in substantially the same plane as the plane of movement of the closure member, and the motor being adapted to rotatively drive the pinion gear via the output shaft in a reversible manner.

With the above-described closure device, the driving force of the motor is transmitted to the pinion gear, and the pinion gear travels along the rack as the pinion gear rotates. Accordingly, the closure member supporting the motor and the pinion gear also travels as a unit with the pinion gear, thereby making it possible to perform an opening and closing operation.

Since the arrangement is such that the output shaft of the motor is located in substantially the same plane as the plane of movement of the closure member, and the motor is disposed in the vicinity of a lower portion of the closure member, the distance between the central line of the closure member and the central line of a rack and pinion assembly for generating a driving force for driving the closure member in the opening and closing direction becomes shorter than that of the conventional arrangement.

In other words, with the conventional arrangement, since the motor is fixed to the side surface of the support member (glass holder 12 in FIG. 8), the overall thickness of the motor has substantially affected the aforementioned distance, so that it has been impossible to dispose the rack in proximity to the closure member.

In accordance with the present invention, since the motor is disposed in face-to-face relation with the moving end surface of the closure member, it is possible to positively shorten the aforementioned distance by the portion of the thickness of the motor.

Accordingly, the angular moment exerted on the closure member can be made small, with the result that it is possible to use a motor having a smaller torque than a conventional one and to effect an efficient and positive opening and closing operation.

Furthermore, if the above-described arrangement is adopted, since it is possible to have the center of gravity of the motor substantially aligned with the central line of the closure member, the effect of an eccentric load can be reduced substantially, which also contributes to a reduction in the motor torque required. If the required torque is small, the weight of the motor itself could be reduced, so that the advantage of the arrangement described can be further appreciated.

Moreover, as a result of shortening the aforementioned distance, it is possible to reduce the thickness of the driving mechanism in the thickness-wise direction of the closure member, thereby making it possible to make more effective use of the surrounding space of the closure device.

DESCRIPTION OF THE PREFERRED EMBODIMENTS

Referring now to the accompanying drawings, a description will be given of the preferred embodiments of the present invention.

Figure 1:
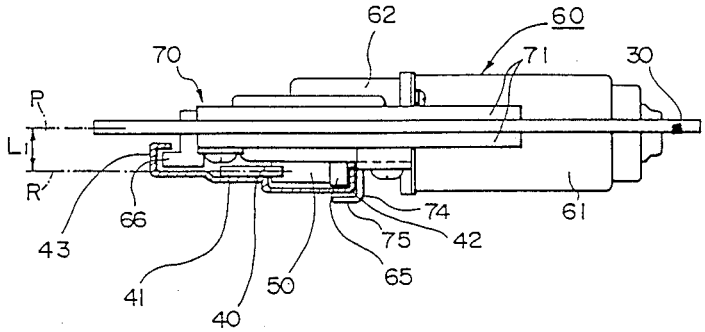
FIG. 1 is a top plan view of a power window mechanism to which the present invention is applied.
Figure 2:
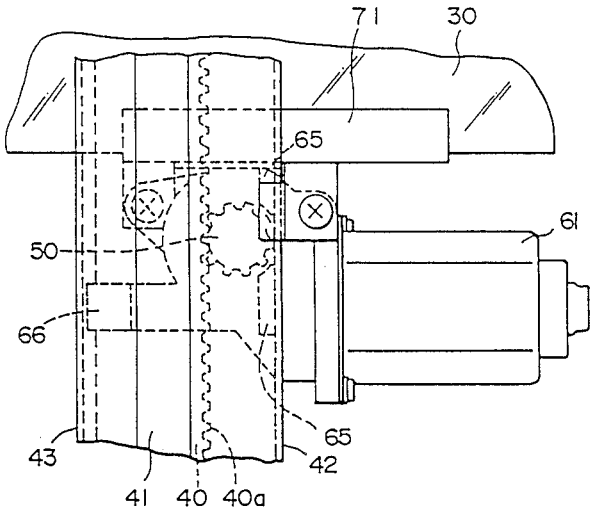
FIG. 2 is a front elevational view thereof.

As shown in FIGS. 1 and 2, a power window to which an embodiment of a closure device in accordance with the present invention is applied comprises a rack 40 fixedly supported along a path of movement of a window glass 30, i.e. a closure member; a pinion gear 50 meshing with the rack 40; a motor 60 for rotatively driving the pinion gear 50 in a reversible manner; and a support member 70 for supporting and fixing the motor 60 to the lower end of the window glass 30.

The rack 40 has teeth **40*a* in a direction perpendicular to the direction of movement of the window glass 30, i.e., in the breadthwise direction of the window glass 30, and is secured to a rack mounting bracket (hereinafter referred to as the bracket) shown in FIGS. 1 to 3. The bracket 41 extends in the same direction as the rack 40 and is arranged to cover the rack 40. As shown by lines P and R in FIG. 3, the rack 40 and the bracket 41 are curved with substantially the same curvature as that of the curved window glass 30. In addition, the bracket 41 is secured by tightening a pair of U-shaped mounting pieces 41*a* formed at upper and lower ends of the bracket 41, respectively, onto an inner panel 32 of the door by means of a pair of bolts 33**.

The bracket 41 has at its opposite ends in its breadthwise direction a pair of hook-shaped engaging portions 42, 43 which are adapted to be retained by first and second engaging projections 65, 66 which will be described later.

Figure 4:
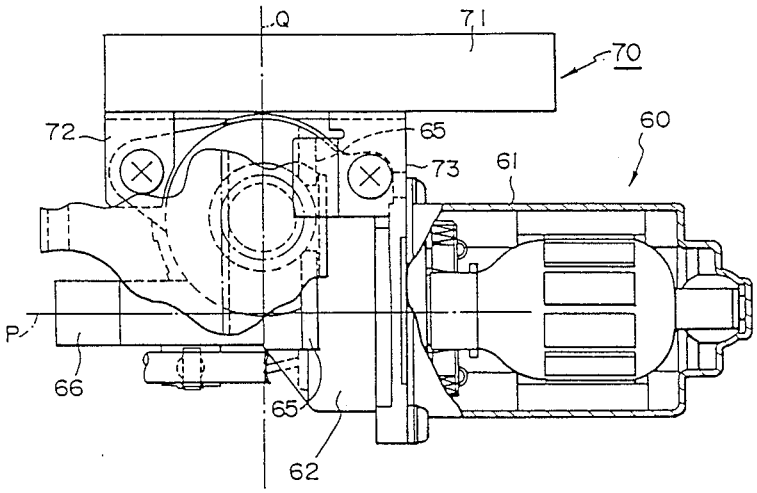
FIG. 4 is a front elevational view of a motor body and a gear housing unit.

As shown in detail in FIG. 4, the motor 60 comprises a motor body 61 and a gear housing unit 62 secured to the motor body 61.

Figure 5:
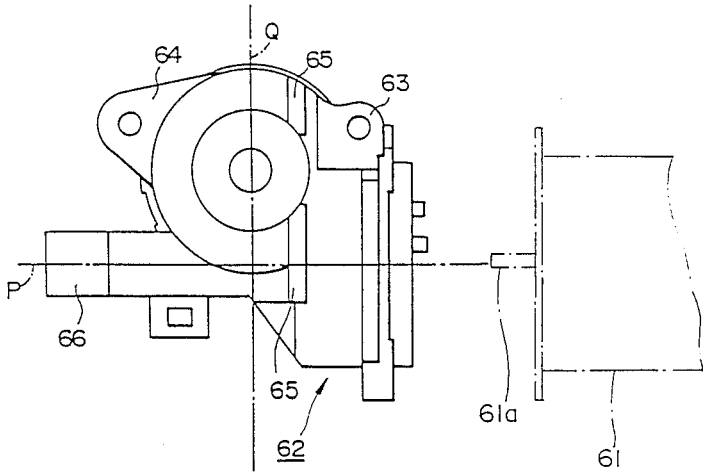
FIG. 5 is a front elevational view of the gear housing unit.

An output shaft **61*a* of the motor body 61 is disposed in alignment with line P shown in FIG. 5, and this line P is also in alignment with the center-of-gravity line of the motor body 61. Furthermore, this line P is in substantially the same plane as the plane of movement of the window glass 30, and is located in the vicinity of a lower portion of the window glass 30. The gear housing unit 62 is adapted to decelerate the output of the motor body 61 and transmit the same to the pinion gear 50** having an axis of rotation in a direction perpendicular to the aforementioned line P, i.e., in a direction perpendicular to the motor shaft.

To give a more detailed description of the gear housing unit 62, the gear housing unit 62 has a member for fixing the motor body 61 to the support member 70 and a member for positioning the bracket 41.

In other words, as shown in FIG. 5, a pair of mounting pieces 63, 64 for mounting the gear housing unit 62 to the support member 70 are formed on the upper side of the gear housing unit 62, and the first engaging projection 65 for retaining one engaging portion 42 of the bracket 41 is also formed thereon (see FIG. 1 as well). In addition, the second engaging projection 66 for retaining the other engaging portion 43 of the bracket 41 is formed at one end of the gear housing unit 62 extending in such a manner as to be aligned with the aforementioned line P. In FIG. 5, line Q indicates the central line of the pinion gear 50.

Figure 6A:
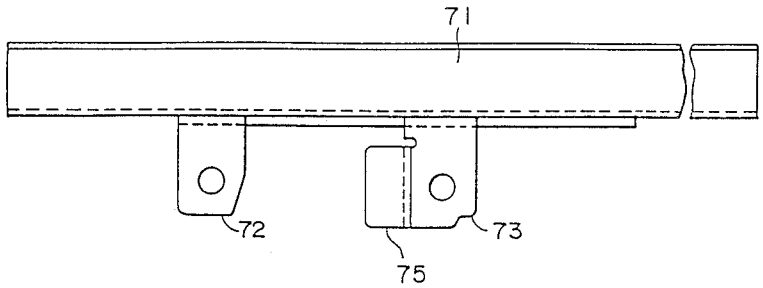
FIGS. 6(A) and 6(B) are a front elevational view and a side elevational view of a support member, respectively.
Figure 6B:
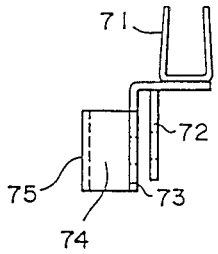

A description will now be given of the support member 70 with specific reference to FIGS. 6(A) and 6(B).

This support member 70 comprises a clamp 71 for clamping the lower end of the window glass 30 and being bonded thereto by means of, for instance, an adhesive; a pair of fixing portions 72, 73 for fixing the motor 60 via the gear housing unit 62; a vertical surface 74 formed by orthogonally bending an edge portion of one fixing portion 73; and a parallel surface 75 formed during assembly in such a manner as to be parallel with the window glass 30.

As the motor 60 is mounted on the window glass 30 by this support member 70, as shown in FIG. 1, when this mechanism is viewed from the moving end of the window glass 30, line P aligned with the output shaft 61*a* of the motor 60 is also aligned with the central line of the window glass 30 in its widthwise direction.

The assembling of the support member 70 is effected in such a manner that one engaging portion 42 of the bracket 41 is first inserted between the vertical surface 74 and the first engaging projection 65 formed on the gear housing unit 62, and then the parallel surface 75 is arranged to cover the outside of the engaging portion 42, as shown in FIG. 1.

The operation of the power window thus constructed will be described hereinunder.

In terms of the driving principle of this power window, in the same manner as conventional proposals concerning the rack-and-pinion system, the output of the motor body 61 is decelerated by the gears of the gear housing unit 62, and is then transmitted to the pinion gear 50 having an axis of rotation in a direction perpendicular to the output shaft 61*a* of the motor body 61.

When this driving force is transmitted, the pinion gear 50 rotates while being meshed with the rack 40. Since the rack 40 is secured to the inner panel 32 of the door via the bracket 41, the pinion gear 50 moves along the rack 40 as the pinion gear 50 rotates.

Since the pinion gear 50 is supported integrally with the motor 60, support member 70, and window glass 30, i.e., the closure member, these members move as a unit together with the pinion gear 50. Hence, as the motor 60 is rotatively driven forwardly and backwardly, it is possible to close and open the window glass 30.

In this embodiment, as viewed from the moving end of the window glass 30, the output shaft 61*a* of the motor body 61 (which is aligned with central line P) is in alignment with the central line of the window glass 30 in the direction of its thickness. Accordingly, distance L1 between the central line (i.e., central line P) of the window glass 30, i.e., the closure member, and the central line (line R shown in FIGS. 1 and 3) of the rack and pinion assembly which produces a driving force for vertically driving the window glass 30 becomes far shorter than distance L2 corresponding to the case of the conventional rack-and-pinion system. More specifically, in this embodiment distance L1 can be shorter by half the respective thickness of the motor and the support member of the conventional arrangement.

In consequence, angular moment exerted on the window glass 30 can be made substantially smaller in proportion to the aforementioned distance than the conventional arrangement, and the frictional force generated during an opening and closing operation can be reduced. Accordingly, it is possible to mount the motor 60 having a smaller torque than a conventional one, and to ensure a more efficient and positive opening and closing operation.

Furthermore, in this embodiment, since the center of gravity of the motor 60 is aligned with the central line of the window glass 30 in the direction of its thickness, the eccentric load on the closure member is reduced substantially, which produces the advantage that the aforementioned angular moment can be reduced.

In addition, by virtue of the above-described arrangement, an additional advantage can be obtained in that the overall thickness of the support member 70, motor 60, rack 40, etc., can be made less than in the case of the conventional arrangement. Accordingly, in the situation where a large number of parts have in recent years come to be incorporated in the inner space of the door in pursuit of sophisticated functions, the reduction of space occupied by the mechanism for the power window has a great advantage in designing the layout of the door interior.

Thus, the fact that the thickness of the door can be made smaller is particularly effective in the case of the curved door having a specified curvature as in the case of this embodiment. In other words, as shown in FIG. 3, since the inner panel 32 of the door usually has a flat surface, the inner space at the upper and lower ends of the door is particularly narrow. If it is possible to reduce the inner space of the door in the direction of its thickness as in the case of this mechanism, it is possible to adopt this type of mechanism even if the door is not made thick, so that the mounting of a power window on a compact car, in particular, can be facilitated appreciably.

Furthermore, in this embodiment, the first and second engaging projections 65, 66 of the engaging portions 42, 43 are provided as members for securing positive meshing engagement between the rack and the pinion gear. The window glass 30 is ordinarily guided by the inner edge of the door, but this guide alone cannot provide a positive engagement between the rack and the pinion gear. In this embodiment, as shown in FIG. 1, one engaging portion 42 of the bracket 41 is made to abut against the outer surface of the first engaging projection 65 formed on the gear housing unit 62, and the other U-shaped engaging portion 43 of the bracket 41 is engaged with and supported by the second engaging projection 66 formed on the gear housing unit 62 by being hooked thereon. As a result, since the position of the bracket 41 in its lateral direction (i.e., breadthwise direction of the window glass 30) is restricted, the meshing engagement between the rack and the pinion gear can be maintained positively.

It should be noted that, to prevent the engaging portion 42 retained by the first engaging projection 66 from coming off, an arrangement is provided such that the engaging projection 42 is covered from the outside by the vertical surface 74 and the parallel surface 75 formed in the support member 70.

It should be understood that the present invention is not restricted to the embodiment described above, and various modifications are possible within the scope of the gist of the invention.

In the described embodiment, the power window in accordance with the present invention is constructed such that the rack 40 is provided with the teeth 40*a* in the breadthwise direction of the window glass 30 perpendicular to the direction of movement of the window glass 30, while the pinion gear 50 is secured to the rotating shaft perpendicular to the output shaft 61*a* of the motor, the gear housing unit 62 being provided to transmit the rotational force of the output shaft 61*a* to that rotating shaft. However, the power window in accordance with the present invention is not necessarily confined to this arrangement.

For instance, the present invention can also be adopted in a case where the rack 40 is provided with the teeth 40*a* in face-to-face relation with the surface of the window glass 30 and the pinion gear 50 is secured to the output shaft of the motor. In this case, since a mechanism for transmitting the motor output to the rotating shaft perpendicular to output shaft of the motor is not required, it is possible to reduce the weight of the mechanism. Nevertheless, since the pinion gear 50 is normally driven by torque obtained by decelerating the motor output, it suffices to provide an arrangement for obtaining an output thus decelerated from the output shaft of the motor.

Figure 7:
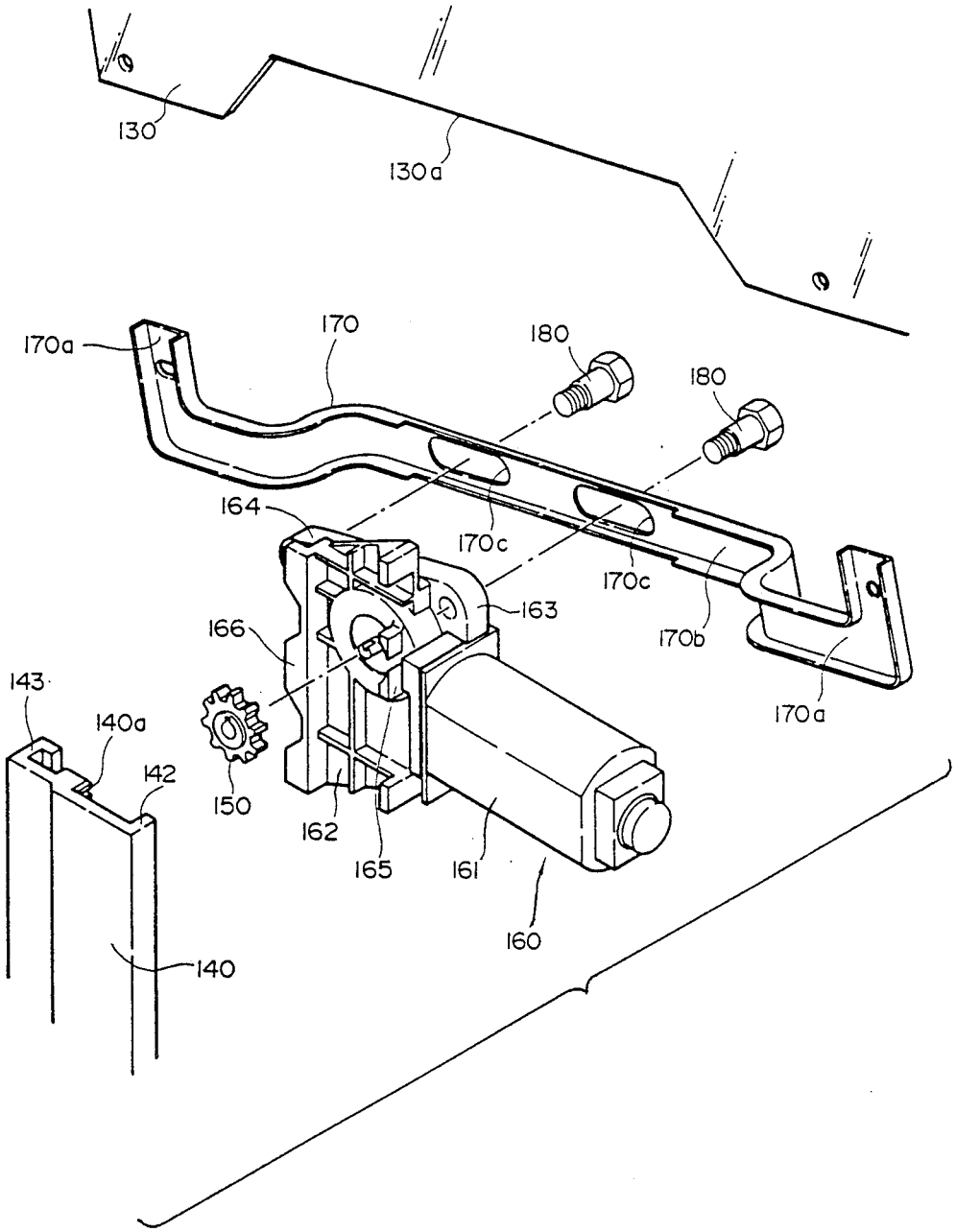
FIG. 7 is a perspective view of a second embodiment of the present invention.
Figure 8:
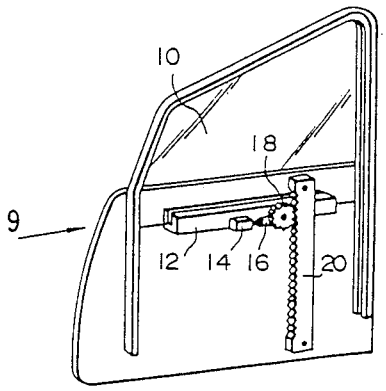
FIG. 8 PRIOR ART
FIG. 8 is a schematic perspective view of a conventional rack-and-pinion type power window.
Figure 9:
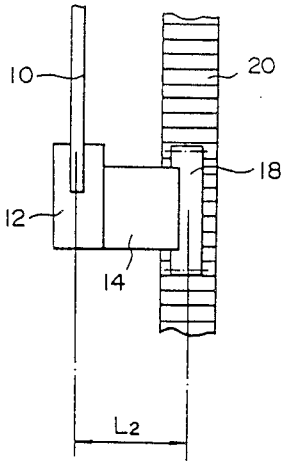
FIG. 9 PRIOR ART
FIG. 9 is a side elevational view taken in the direction of arrow 9 in FIG. 8.

Referring now to FIG. 7, a description will be given of a second embodiment of the present invention.

In this embodiment, a recess 130*a* is formed at a lower end surface of a window glass 130 at an intermediate portion thereof in its breadthwise direction. A support member 170 is constituted by an elongated member in the form of a channel. This support member 170 has at its opposite ends a pair of bent portions 170*a* extending in the direction of the window glass 130 (i.e., upwardly). The support member 170 is fixed to the window glass 130 by superposing the bent portions 170*a* on one surface of the window glass 130 at the lower end thereof and securing the same by means of unillustrated mounting members such as screws. In addition, a longitudinally intermediate portion of the support member 170 has a U-shaped projection 170*b* formed by being bent in such a manner as to extend from one side to the other side of the window glass 130 in correspondence with the recess 130*a*. A space defined by the inner side of this projection 170*b* and the recess 130*a* serves as a space for accommodating a motor 160. A pair of slits 170*c* extending in the longitudinal direction of the support member 170 are formed at the bottom of the projection 170*b*.

The motor 160 includes a motor body 161 and a gear housing unit 162 secured to the motor body 161 in the same way as the first embodiment.

The gear housing unit 162, in the same way as the first embodiment, has a pair of mounting pieces 163, 164 for mounting the motor body 161 on the support member 170, and a first engaging projection 165 and a second engaging projection 166 are formed thereon in a projecting manner.

Meanwhile, a rack 140 is formed of resin and includes the following: a teeth portion 140*a* for meshing with a pinion gear 150 rotatively driven by the motor 160 reversibly; an engaging portion 142 into which the first engaging projection 165 is inserted in correspondence with the first engaging projection 165; and a U-shaped engaging portion 143 in which the second engaging projection 166 is accommodated, the engaging portions 142, 143 being disposed at opposite ends of the rack 140 in its breadthwise direction.

Accordingly, with the pinion gear 150 meshing with the teeth portion 140*a* of the rack 140, the movement of the pinion gear 150 in the breadthwise direction of the window glass 130 is restricted by the first engaging projection 165 and the engaging portion 142, while the movement of the pinion gear 150 in the direction of the thickness of the window glass 130 is restricted by the second engaging projection 166 and the engaging portion 143, so as to ensure that a meshing condition between the pinion gear 150 and the rack 140 can be maintained positively. In addition, since the rack 140 is formed of resin, the generation of noises due to the meshing engagement between the rack 140 and the pinion gear 150 can be controlled.

A description will now be given of the assembling of the motor 160 to the support member 170.

The motor 160 is positioned at the projection 170*b* of the support member 170, and the slits 170*c* are arranged facing the mounting pieces 163, 164.

The motor 160 is position at the projection 170*b* of the support member 170, and the slits 170*c* and the mounting pieces 163, 164 are made to oppose each other.

Figure 3:
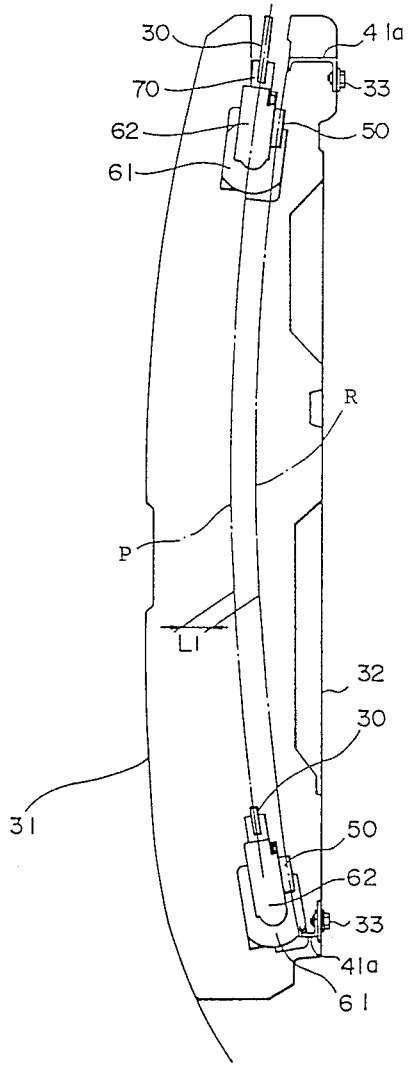
FIG. 3 is a schematic diagram illustrating the path of movement within a door interior.

Then, the motor 160 and the support member 170 are fixed by means of a pair of screws 180 in such a manner that the output shaft of the motor body 161 (the center of gravity of the motor 160) is substantially aligned with the path of movement of the window glass 130 to which the support member 170 is fixed, i.e., the central line of the window glass 130 in the direction of its thickness (line P in FIG. 3). Incidentally, the position of the motor 160 in the breadthwise direction of the window glass 130 can be adjusted by means of the slits 170*c*.

Since this embodiment is thus arranged, the angular moment exerted on the window glass 130 can be reduced substantially as compared with the prior art.

In addition, since the center of gravity of the motor 160 is in alignment with the central line of the window glass 130 in the direction of its thickness, the eccentric load applied to the window glass 130 can be reduced appreciably.

Although in this embodiment the window glass 130 is provided with the recess 130*a*, and the support member 170 is provided with the projection 170*b*, only either one of them may be provided in the present invention.

In addition, the present invention is not necessarily applied solely to the power window, and is applicable to apparatuses in various fields for opening and closing a closure member by the use of a motor.

To cite an automobile by way of example, the present invention may be applied to opening and closing sunroof panels that have become popular in recent years.

As described above, in accordance with the present invention, it is possible to effect a reduction in the number of parts used, which is an advantage of the rack-and-pinion system, and secure the effective inner space of the door. In addition, it is possible to shorten the distance between the operating point of the closure member and the driving point of the rack and pinion assembly as compared with the prior art. Accordingly, it is possible to drive the closure member efficiently, thereby allowing an opening and closing operation to be carried out positively with a smaller motor torque than the prior art.

Furthermore, since the thickness of the mechanism parts corresponding to the thickness-wise direction of the closure member can be made far smaller, it is possible to make effective use of the inner space for other usages.

What is claimed is:

1. A closure device for opening and closing an opening by moving a closure member substantially vertically, comprising:

a rack extending in the direction of movement of said closure member;

a pinion gear meshing with said rack; and a motor having an output shaft connected to said pinion gear, said motor being supported by a lower portion of said closure member in such a manner that said output shaft is located in substantially the same plane as the plane of movement of said closure member, and said motor being adapted to rotatively drive said pinion gear via said output shaft in a reversible manner.

2. A closure device according to claim 1, wherein said motor is supported at a lower portion of said closure member via a support member secured to a lower portion of said closure member.

3. A closure device according to claim 2, wherein said closure member is made of a plate-like member, and said support member is constituted by an elongated member extending along the breadthwise direction of said plate-like member and has its opposite ends extending upwardly and serving as fixing portions for fixing said elongated member to said plate-like member.

4. A closure device according to claim 3, wherein said elongated member has at an intermediate portion thereof between said fixing portions a projection projecting from said one side to the other side of said plate-like member, said motor being supported by said projection in such a manner that said output shaft is located in substantially the same plane as the plane of movement of said plate-like member.

5. A closure device according to claim 2, wherein said closure member is made of a plate-like member and has at a lower end thereof a recess formed at a breadthwise intermediate portion thereof, and said support member is constituted by an elongated member extending along the breadthwise direction of said plate-like member and has its opposite ends extending upwardly and serving as fixing portions for fixing said elongated member to said plate-like member.

6. A closure device according to claim 2, wherein said closure member is made of a plate-like member, and said support member is constituted by an elongated member extending along the breadthwise direction of said plate-like member and has a clamping portion for clamping and fixing a lower end portion of said plate-like member.

7. A closure device according to claim 2, further comprising maintenance means for maintaining a meshing condition between said rack and said pinion gear.

8. A closure device according to claim 7, said maintenance means comprises a pair of engaging projections provided on said motor in such a manner as to be spaced apart from each other in the direction in which said rack and said pinion mesh with each other, and a pair of engaging portions which are disposed on a bracket for covering said rack, said pair of engaging portions being located outwardly of said pair of engaging projections and adapted to prevent said motor from moving in the direction in which the meshing engagement between said rack and said pinion gear is canceled.

9. A closure device according to claim 7, wherein said maintenance means comprises a pair of engaging projections provided on said motor in such a manner as to be spaced apart from each other in the direction in which said rack and said pinion gear mesh with each other, and a pair of engaging portions which are disposed on said rack along the direction of movement of said closure member, said pair of engaging portions being located outwardly of said pair of engaging projections and adapted to prevent said motor from moving in the direction in which the meshing engagement between said rack and said pinion gear is canceled.

10. A closure device according to claim 1, wherein said closure member is curved at a specified curvature along the direction of movement thereof, and said rack is curved with substantially the same curvature as that of said closure member along the direction of movement of said closure member.

11. A closure device according to claim 1, wherein said rack is formed of resin.

12. A closure device for opening and closing an opening by moving a closure member substantially vertically, comprising:

a rack extending in the direction of movement of said closure member;

a pinion gear meshing with said rack; and a motor supported by a lower portion of said closure member in such a manner that its center of gravity is substantially located on an extension of the path of movement of said closure member, said motor being adapted to rotatively drive said pinion gear in a reversible manner.

13. A closure device according to claim 12, wherein said motor is supported at a lower portion of said closure member via a support member secured to a lower portion of said closure member.

14. A closure device according to claim 13, wherein said closure member is curved at a specified curvature along the direction of movement thereof, and said rack is curved with substantially the same curvature as that of said closure member along the direction of movement of said closure member.

15. A closure device according to claim 13, wherein said closure member is made of a plate-like member and has at a lower end thereof a recess formed at a breadthwise intermediate portion thereof, and said support member is constituted by an elongated member extending along the breadthwise direction of said plate-like member and has its opposite ends extending upwardly and serving as fixing portions for fixing said elongated member to said plate-like member.

16. A closure device according to claim 15, wherein said fixing portions of said elongated member are secured to one surface of said plate-like member at breadthwise opposite sides thereof in the vicinity of said recess, an intermediate portion of said elongated member being formed as a projection projecting from said one side to the other side of said plate-like member, said center of gravity of said motor being located on said extension of the path of movement of said plate-like member, and said motor being secured to the inner side of said projection.

17. A closure device according to claim 12, wherein said pinion is rotatively driven in a reversible manner via an output shaft of said motor.

18. A closure device according to claim 17, further comprising maintenance means for maintaining a meshing condition between said rack and said pinion gear.

19. A closure device according to claim 18, said maintenance means comprises a pair of engaging projections provided on said motor in such a manner as to be spaced apart from each other in the direction in which said rack and said pinion mesh with each other, and a pair of engaging portions which are disposed on a bracket for covering said rack, said pair of engaging portions being located outwardly of said pair of engaging projections and adapted to prevent said motor from moving in the direction in which the meshing engagement between said rack and said pinion gear is canceled.

20. A closure device according to claim 18, wherein said maintenance means comprises a pair of engaging projections provided on said motor in such a manner as to be spaced apart from each other in the direction in which said rack and said pinion gear mesh with each other, and a pair of engaging portions which are disposed on said rack along the direction of movement of said closure member, said pair of engaging portions being located outwardly of said pair of engaging projections and adapted to prevent said motor from moving in the direction in which the meshing engagement between said rack and said pinion gear is canceled.

* * * * *